US007401875B2

(12) United States Patent
Jacobsen et al.

(10) Patent No.: US 7,401,875 B2
(45) Date of Patent: Jul. 22, 2008

(54) INKJET PRINTHEAD INCORPORATING A MEMORY ARRAY

(75) Inventors: Stuart M. Jacobsen, Frisco, TX (US); Mary Roby, Plano, TX (US); Erika Shoemaker, Richardson, TX (US); Maria Wang, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 264 days.

(21) Appl. No.: 10/888,407

(22) Filed: Jul. 9, 2004

(65) Prior Publication Data

US 2006/0007258 A1 Jan. 12, 2006

(51) Int. Cl.
*B41J 29/38* (2006.01)

(52) U.S. Cl. ..... 347/14; 347/56; 347/58

(58) Field of Classification Search ..... 347/14
See application file for complete search history.

(56) References Cited

U.S. PATENT DOCUMENTS 4,189,785 A * 2/1980 Rapp ..... 365/156
4,432,530 A 2/1984 Marcinek
4,719,477 A 1/1988 Hess
4,928,117 A * 5/1990 Takeuchi ..... 347/195
4,947,192 A 8/1990 Hawkins et al.
5,675,365 A * 10/1997 Becerra et al. ..... 347/9
6,022,094 A * 2/2000 Gibson et al. ..... 347/19
6,292,395 B1 * 9/2001 Lin ..... 365/185.2
6,435,668 B1 * 8/2002 Barbour et al. ..... 347/60
6,578,943 B2 * 6/2003 Arquilevich et al. ..... 347/15
6,773,083 B2 * 8/2004 Fields et al. ..... 347/5
6,906,575 B2 * 6/2005 Tanaka ..... 327/536
2002/0118242 A1 * 8/2002 Tajima et al. ..... 347/17
2003/0143793 A1 * 7/2003 Horch et al. ..... 438/200
2003/0214853 A1 * 11/2003 Hosono et al. ..... 365/200
2004/0001133 A1 * 1/2004 Critelli et al. ..... 347/101
2004/0183842 A1 * 9/2004 Kobayashi et al. ..... 347/10
2005/0231545 A1 * 10/2005 Benjamin et al. ..... 347/19

* cited by examiner

*Primary Examiner*—Matthew Luu
*Assistant Examiner*—Brian J Goldberg
(74) *Attorney, Agent, or Firm*—Rose Alyssa Keagy; W. James Brady, III; Frederick J. Telecky, Jr.

(57) ABSTRACT

A thermal inkjet printhead 100 of the present invention includes a heating element 110, an ink chamber, control circuitry 108, an ink reservoir, and a memory array 106. The control circuitry 108 causes the heating element to generate thermal energy thereby causing ink within the ink chamber to generate bubbles of ink, which are then expelled through a nozzle. The ink reservoir replenishes used ink in the ink chamber. The memory array 106 stores and provides the identification parameters for the thermal inkjet printhead 100. The identification parameters are typically provided during initialization of the printer and include color(s) of ink (e.g., black, green, red, blue), a number of nozzles on the thermal inkjet printhead, an addressing frequency, nozzle spacing, heating architecture, and the like. The identification parameters can include other information such as a unique serial identification number for the thermal inkjet printhead, manufacturer serial number, lot number, date of manufacture, compatible printers, ink capacity, ink remaining, re-ordering information for replacement ink cartridges, and the like.

13 Claims, 12 Drawing Sheets

INKJET PRINTHEAD INCORPORATING A MEMORY ARRAY

FIELD OF THE INVENTION

The present invention relates generally to the inkjet printers, and more particularly, to inkjet printhead systems and methods of fabrication.

BACKGROUND OF THE INVENTION

Thermal inkjet technology is a relatively common method of inkjet printing. Thermal inkjet technology continues to progress in terms of print quality for text and graphics and offers significant performance verses cost as compared with other types of print technology. Thermal inkjet technology has a number of advantages including small drop sizes, high printhead operating frequency, system reliability and controlled ink drop placement.

Thermal inkjet technology includes thermal inkjet printers that employ inkjet cartridges to print bubbles or drops of ink onto a printable medium, such as paper. The inkjet cartridges employed in thermal inkjet printers include thermal inkjet printheads that use heat to generate ink vapor bubbles, ejecting small drops of ink through nozzles and placing them precisely on a surface to form text or images.

The thermal inkjet printheads are fabricated in/on a semiconductor material on which components, including heating elements, ink reservoirs, channels, and nozzles. The heating elements, typically a thin film resistor, and the ink reservoirs are formed in or on a semiconductor substrate. Channels are formed on the semiconductor substrate in order to connect the heating elements to the ink reservoirs. Nozzles are formed on the heating elements through which droplets of ink can be ejected. A single inkjet printhead can include one or more sets of nozzles, heating elements, and ink reservoirs for a particular color of ink. Multiple sets can be employed to permit multiple colors to be printed.

During operation, the heating elements superheat a small amount of ink within its chambers thereby forming gas or thermal bubbles, which are ejected through the nozzles and onto a printing source (e.g., paper). The heating elements are driven by drive circuitry that passes pulses of current through the heating elements.

Thermal inkjet printheads and the inkjet cartridges comprising them are generally specific to a particular printer or group of printers. Varied printers have different printing capabilities, requirements, printing commands, and the like that limit the number of cartridges employable in a given printer. As a result, inkjet cartridges are often made for a specific printer or group of related printers and are designed to work with only the specific printer or group of related printers.

One problem that can occur is when a non-compatible print cartridge is employed by a printer. Undesired consequences, such as poor printing, incorrect colors, and even printer damage can result.

SUMMARY OF THE INVENTION

The following presents a simplified summary in order to provide a basic understanding of one or more aspects of the invention. This summary is not an extensive overview of the invention, and is neither intended to identify key or critical elements of the invention, nor to delineate the scope thereof. Rather, the primary purpose of the summary is to present some concepts of the invention in a simplified form as a prelude to the more detailed description that is presented later.

The present invention facilitates thermal inkjet technology by allowing ink jet cartridges to be employed in a relatively greater range of printers than conventional thermal inkjet printheads permit. Ink jet cartridges employ a thermal inkjet printhead that includes a memory array for storing identification parameters. Printers that employ the ink jet cartridges of the present invention can obtain and employ the identification parameters in order to identify commands and/or directives compatible with operating the ink jet cartridges. As a result, printers can employ a relatively larger number of ink jet cartridges and ink jet cartridges can be employed in a relatively larger number of printers.

A thermal inkjet printhead of the present invention includes a heating element, an ink chamber, drive circuitry, an ink reservoir, and a memory array. The drive circuitry causes the heating element to generate thermal energy thereby causing ink within the ink chamber to generate bubbles of ink, which are then expelled through a nozzle. The ink reservoir replenishes used ink in the ink chamber. The memory array stores and provides the identification parameters for the thermal inkjet printhead. The identification parameters are typically provided during initialization of the printer and include color(s) of ink (e.g., black, green, red, blue), a number of nozzles on the thermal inkjet printhead, an addressing frequency, nozzle spacing, heating architecture, and the like. The identification parameters can include other information such as a unique serial identification number for the thermal inkjet printhead, manufacturer serial number, lot number, date of manufacture, compatible printers, ink capacity, ink remaining, re-ordering information for replacement ink cartridges, and the like.

To the accomplishment of the foregoing and related ends, the invention comprises the features hereinafter fully described and particularly pointed out in the claims. The following description and the annexed drawings set forth in detail certain illustrative aspects and implementations of the invention. These are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE INVENTION

The present invention will now be described with respect to the accompanying drawings in which like numbered elements represent like parts. The figures provided herewith and the accompanying description of the figures are merely provided for illustrative purposes. One of ordinary skill in the art should realize, based on the instant description, other implementations and methods for fabricating the devices and structures illustrated in the figures and in the following description.

The present invention facilitates thermal inkjet technology by allowing ink jet cartridges to be employed in a relatively greater range of printers than conventional thermal inkjet printheads permit. Ink jet cartridges employ a thermal inkjet printhead that includes a memory array for storing identification parameters. Printers that employ the ink jet cartridges of the present invention can obtain and employ the identification parameters in order to identify commands and/or directives compatible with operating the ink jet cartridges. As a result, printers can employ a relatively larger number of ink jet cartridges and ink jet cartridges can be employed in a relatively larger number of printers.

Conventional inkjet printheads are limited in their use, despite their capabilities, because they are severely limited in what identification information they provide. Generally, inkjet printheads include no identification information or include a small amount of information (e.g., a single bit indicating 9 or 12 nozzles present) in a small number of fuses (e.g., 4 fuses). In contrast, a thermal inkjet printhead of the present invention employs a memory array capable of storing a relatively large amount of information (e.g., 1024 bits).

Figure 1:
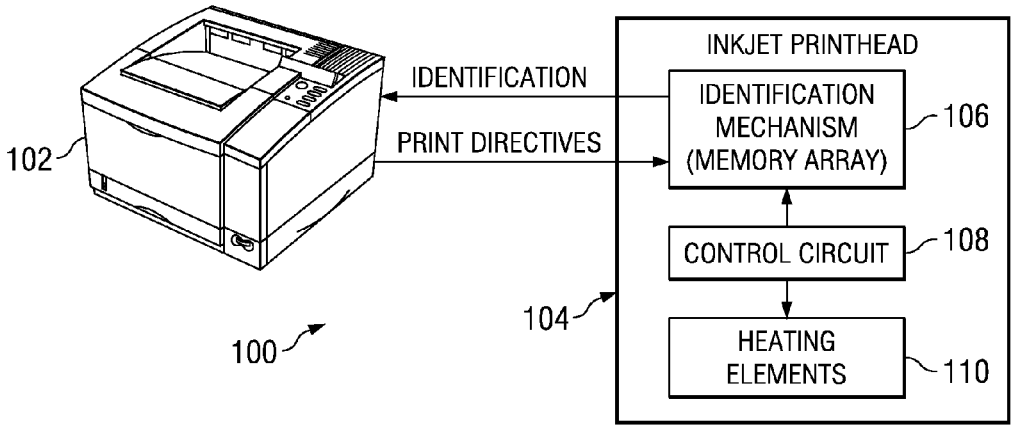
FIG. 1 is a block diagram illustrating a thermal inkjet printer system in accordance with an aspect of the present invention.
Figure 2:
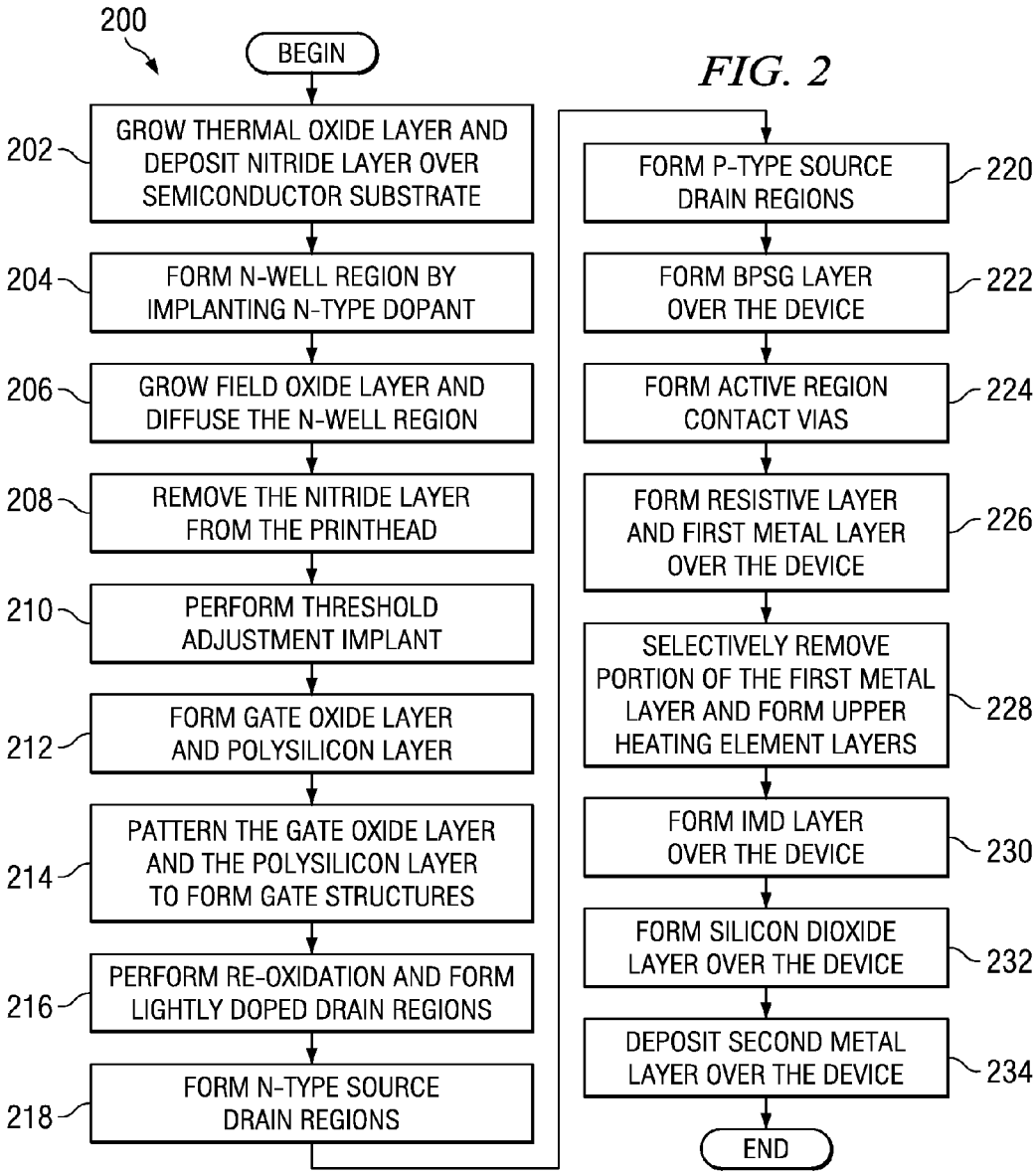
FIG. 2 depicts a flow diagram illustrating a method of fabricating a thermal inkjet printhead incorporating a memory array in accordance with an aspect of the present invention.

FIG. 1 is a block diagram illustrating a thermal inkjet printer system 100 in accordance with an aspect of the present invention. The system 100 includes a printer mechanism 102 and a thermal inkjet printhead 104 and is typically fabricated on a single integrated circuit. For simplicity, the system 100 is described with a single printhead, but it is appreciated that the system 100 can include one or more printheads in addition to the printhead 104.

The printer mechanism 102 can be connected to other electronic devices, such as a computer, digital camera, and the like, and is operable to cause text and/or graphics to be printed on a source material (e.g., paper). The printer mechanism 102 initiates and controls printing by sending print directives or print commands to the thermal inkjet printhead 104. At least some of the print directives are specific to the thermal inkjet printhead 104, whereas as other print directives are not. The print directives are at least partially based on identification parameters received from the inkjet printhead 104. These parameters include color(s) of ink (e.g., black, green, red, blue), a number of nozzles on the thermal inkjet printhead 104, an addressing frequency, nozzle spacing, heating architecture, and the like. The identification parameters can include other information such as a unique serial identification number for the thermal inkjet printhead, manufacturer serial number, lot number, date of manufacture, compatible printers, ink capacity, ink remaining, re-ordering information for replacement ink cartridges, and the like. The printer mechanism 102 generally requests the identification parameters from the thermal inkjet printhead 104 during initialization, which can occur, for example, on the printer mechanism 102 being turned on or being reset. This request for identification information can be referred to as an identification directive.

The thermal inkjet printhead 104 includes a memory array 106, a control circuit 108, and one or more heating elements 110. The memory array 106 comprises a number of memory cells that store the identification parameters for the thermal inkjet printhead 104 and can be accessed by the printer mechanism 102 to retrieve the identification parameters.

The cells within the memory array 106 are organized in rows and columns. Column transistors and row transistors are employed to accessed and/or read individual memory cells and groups of memory cells. Typically, column transistors are connected to sources of columns of memory cells and row transistors are connected to drains of rows of memory cells. Programming, reading, and erasing are performed on the memory array 106 by appropriately biasing sources and drains of the memory cells of the array 106 without specifically biasing gates of the memory cells within the array 106. However, it is appreciated that other suitable programming procedures can be employed to program the memory array 106 in accordance with the present invention.

To read an individual memory cell, an appropriate column transistor and an appropriate row transistor are turned on. Current of the individual memory cell is then measured to determine the stored value of the individual memory cell. Programming of memory cells is typically done as part of the printhead 104 manufacturing process, but the present invention also includes programming before and after installation in a thermal inkjet printer system. As an example, programming of individual memory cells is accomplished by biasing a source to about 8 to 12 volts and biasing a drain to about 0 to 2 volts. Erasing of memory cells is typically performed as a blanket operation by, for example, ultraviolet radiation.

The control circuit 108 receives the print directives from the printer mechanism 102 and causes an appropriate action to be performed. One such directive is a request for identification. On receiving this directive, the control circuit selects appropriate memory cells within the memory array 106 thereby accessing the identification parameters, which are then provided to the printer mechanism 102. On receiving a directive to print, the control circuit 108 generates or causes drive circuitry to generate a suitable electronic pulse or allows a suitable electronic pulse from the printer mechanism 102 to be connected to the heating element(s) 110. As a result, the heating element(s) 110 heat ink within its chambers causing one or more bubbles to be formed and expelled through its nozzle. The expelled bubbles partially form text and/or graphics on a print medium, such as paper.

The heating element(s) 110 are comprised of a thin film resistor that generates heat in response to a suitable electric pulse. The heating element(s) 110 include chambers that are connected to ink reservoir(s) via channel(s). The chamber(s), as stated above, hold amounts of ink that becomes superheated by a suitable electric pulse. Expelled ink, as expelled bubbles of ink, is replaced in the chamber by ink flowing from the reservoir through the channel.

FIGS. 2A, 2B, 2C, and 2D are a flow diagram illustrating a method 200 of fabricating a thermal inkjet printhead incorporating a memory array in accordance with an aspect of the present invention. FIGS. 3 to 20 are provide to illustrate suitable structure obtained in performing the method 200.

Figure 3:
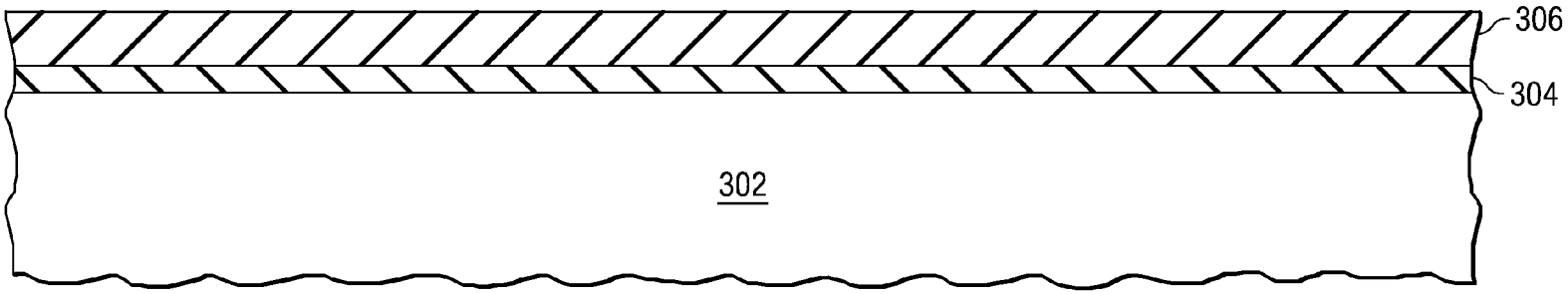
FIG. 3 is a cross sectional view illustrating the thermal inkjet printhead after formation of the nitride layer array in accordance with an aspect of the present invention.

The method begins at block 202 wherein a thermal oxide layer 304 is grown on a semiconductor substrate and 302 a nitride layer 306 is deposited on the thermal oxide layer 304. FIG. 3 is a cross sectional view illustrating the thermal inkjet printhead after formation of the nitride layer 306. The thermal oxide layer 304 is grown to a suitable thickness, for example, about 185 Angstroms and the nitride layer 306 is deposited with a suitable thickness, for example 650 Angstroms. The semiconductor substrate 302 is comprised of a semiconductor material, such as silicon or silicon-germanium and may be doped or undoped.

Figure 4:
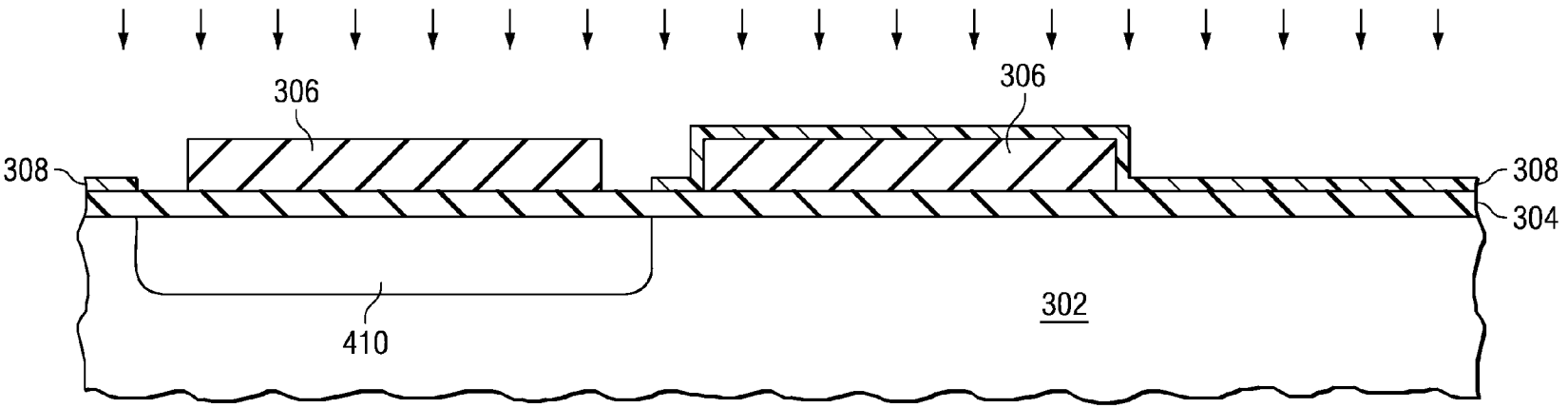
FIG. 4 is a cross sectional view illustrating the thermal inkjet printhead after formation of the n-well region array in accordance with an aspect of the present invention.

Continuing with the method 200, an N-tank implant is performed at block 204 to form an n-well region 410 for a p-type transistor. FIG. 4 is a cross sectional view illustrating the thermal inkjet printhead after formation of the n-well region 410. Prior to the N-tank implant, the nitride layer 306 is patterned and a layer of resist 308 is deposited and employed to selectively expose a region for formation of the n-well region 410. A suitable n-type dopant, such as phosphorus, is implanted with a selected energy and dose. The dopant is able to pass through exposed portions of the nitride layer 306. After formation of the n-well region 410, the resist 308 is removed.

Figure 5:
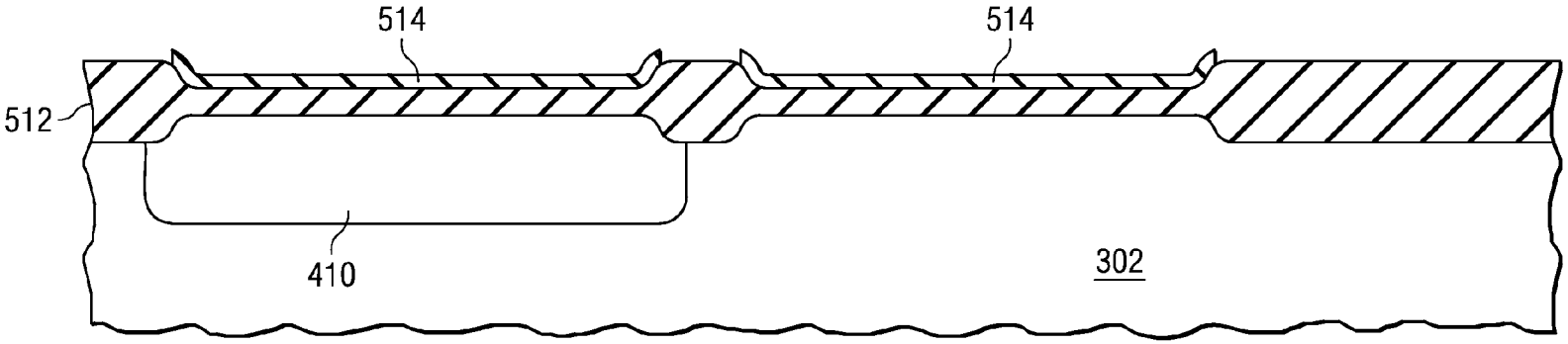
FIG. 5 is a cross sectional view illustrating the thermal inkjet printhead after growing the field oxide layer and diffusing the n-well region array in accordance with an aspect of the present invention.

At block 206, a field oxide layer 512 is grown and the n-well region 410 is diffused. FIG. 5 is a cross sectional view illustrating the thermal inkjet printhead after growing the field oxide layer 512 and diffusing the n-well region 410. The field oxide layer 512 is grown to a suitable thickness, for example 10,000 Angstroms. However, portions of the field oxide layer 512 below the silicon nitride layer 306 are substantially thinner and can be non-existent. The n-well region 410 is diffused and expanded to take on a suitable shape, such as shown in FIG. 5.

Figure 6:
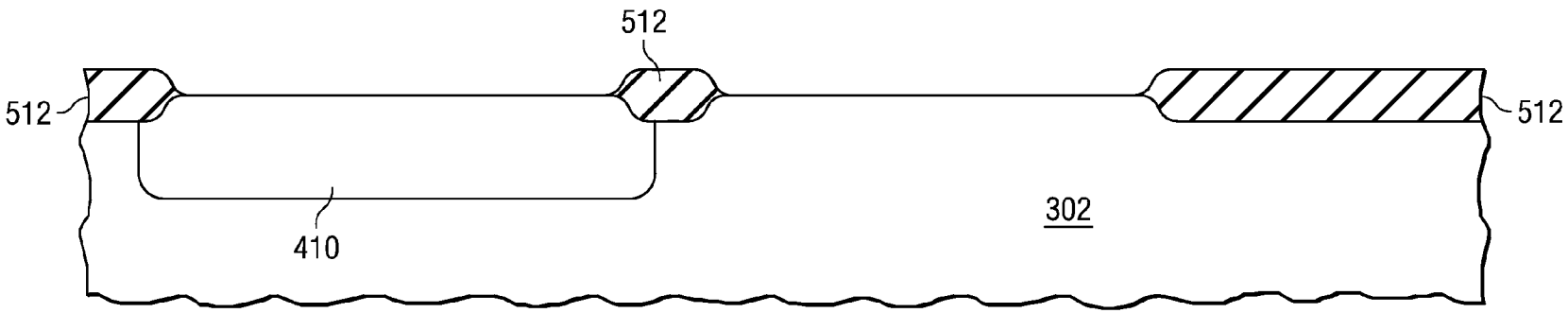
FIG. 6 is a cross sectional view illustrating the thermal inkjet printhead after removal of the nitride layer array in accordance with an aspect of the present invention.

The nitride layer 306 is removed from the printhead at block 208. A suitable nitride stripping process, such as a chemical strip with HF and hot Phosphoric acit, can be employed. Additionally, a portion of the field oxide layer 512 is removed. FIG. 6 is a cross sectional view illustrating the thermal inkjet printhead after removal of the nitride layer 306.

Figure 7:
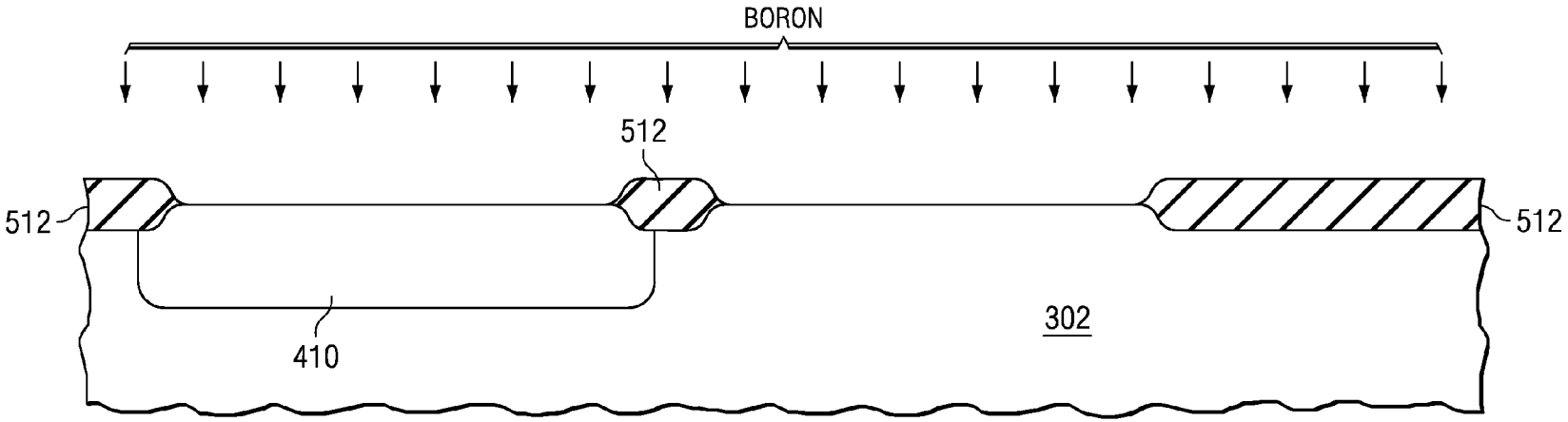
FIG. 7 is a cross sectional view illustrating the thermal inkjet printhead during the threshold voltage adjustment implant array in accordance with an aspect of the present invention.
Figure 8:
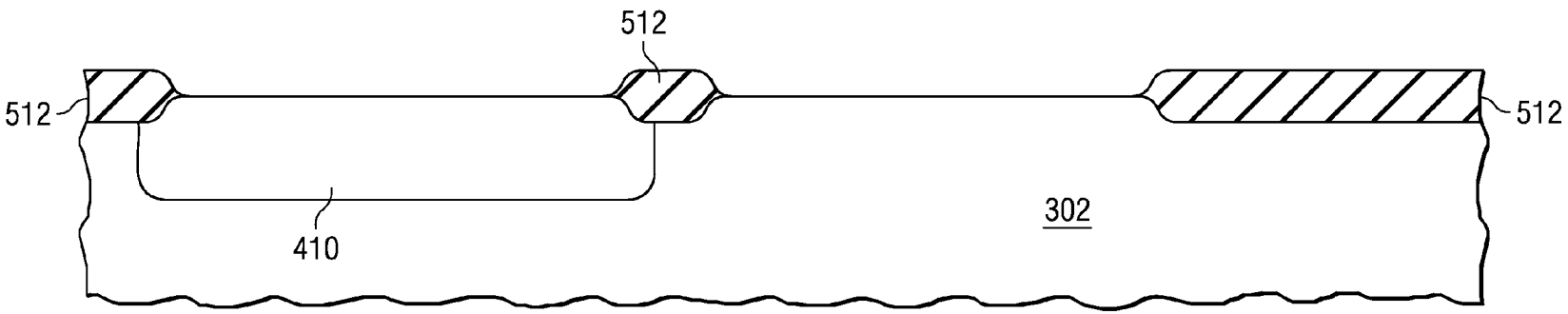
FIG. 8 is a cross sectional view illustrating the thermal inkjet printhead after performing the threshold voltage adjustment implant array in accordance with an aspect of the present invention.

A threshold adjustment implant is performed at block 210 in order to adjust threshold voltages for the p-type and n-type transistors. A suitable dopant, such as boron, is deposited with a selected energy and dose to alter the threshold values. A relatively thin "dummy" oxide layer (e.g., about 250 Angstroms) is typically deposited before performing the implant in order to mitigate damage to the semiconductor substrate 302. FIG. 7 is a cross sectional view illustrating the thermal inkjet printhead during the threshold voltage adjustment implant. FIG. 8 is a cross sectional view illustrating the thermal inkjet printhead after performing the threshold voltage adjustment implant.

Figure 9:
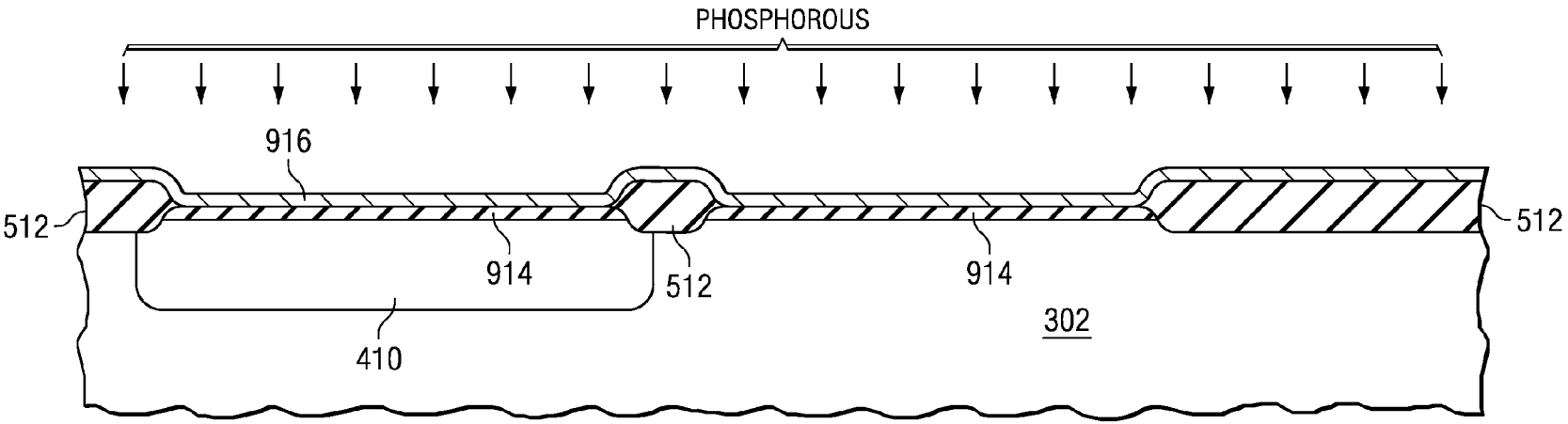
FIG. 9 is a cross sectional view illustrating the thermal inkjet printhead after formation of the gate oxide layer and the polysilicon layer array in accordance with an aspect of the present invention.

Continuing with the method 200, a gate oxide layer 914 and a polysilicon layer 916 are formed on the device at block 212. FIG. 9 is a cross sectional view illustrating the thermal inkjet printhead after formation of the gate oxide layer 914 and the polysilicon layer 916. Prior to forming the gate oxide layer 914, remaining oxide in the p-type transistor region and the n-type transistor region is stripped. Then, the gate oxide layer 914 is grown on the device to a suitable thickness, for example 200 Angstroms. Subsequently, the polysilicon layer 916 is formed on the gate oxide layer 914 by a suitable polysilicon deposition process. The polysilicon layer 916 has a suitable thickness, for example 4,500 Angstroms and is doped with phosphorous.

Figure 10:
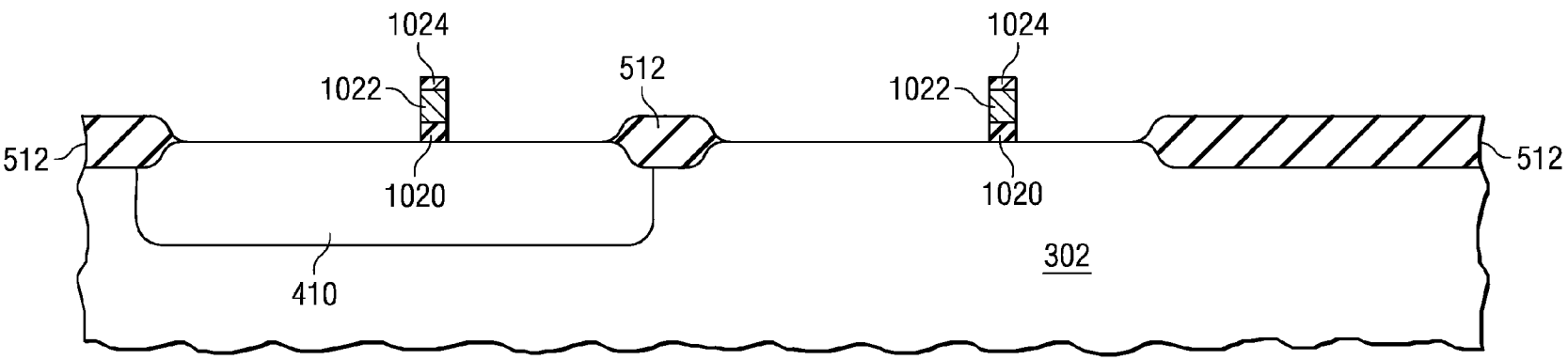
FIG. 10 is a cross sectional view illustrating the thermal inkjet printhead after performing the patterning operation array in accordance with an aspect of the present invention.

The polysilicon layer 916 and the gate oxide layer 914 are patterned at bock 214 to form gate structures comprised of gate oxide regions 1020 and polysilicon gates 1022. FIG. 10 is a cross sectional view illustrating the thermal inkjet printhead after performing the patterning operation. A layer of resist 1024, shown in FIG. 10, is employed to expose regions of the gate oxide layer 914 and the polysilicon layer to be removed. Then, the exposed regions are removed leaving the gate structures. Subsequently, the layer of resist 1024 is removed.

Figure 11:
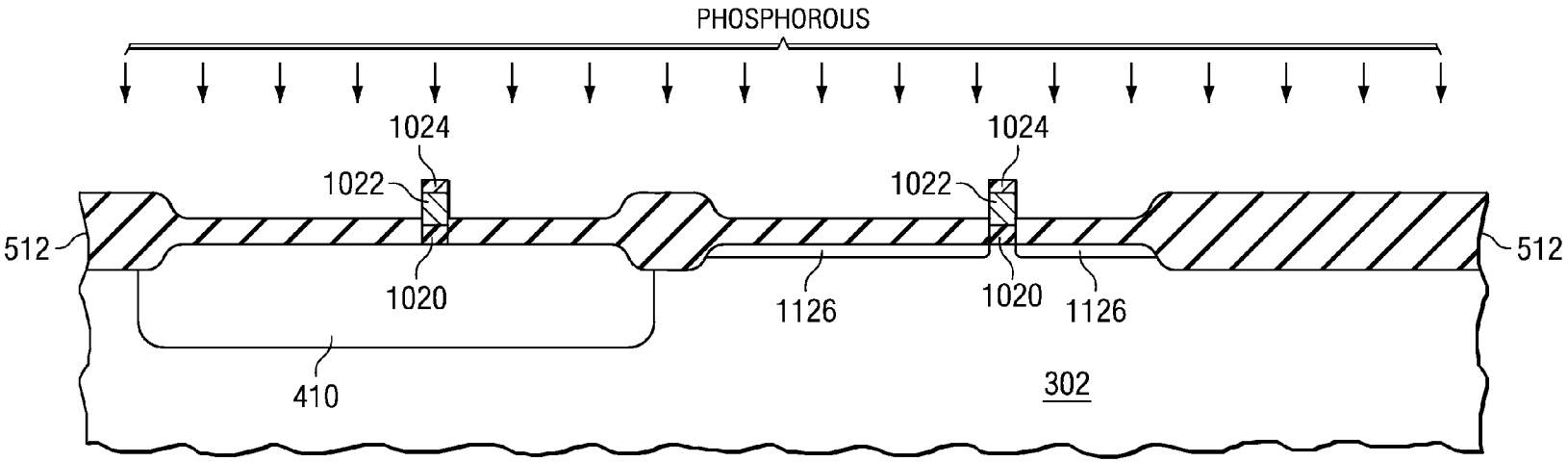
FIG. 11 is a cross sectional view illustrating the thermal inkjet printhead after forming the LDD regions array in accordance with an aspect of the present invention.

Continuing at block 216, a reoxidation is performed and lightly doped drain (LDD) regions 1126 are formed within the n-type transistor region. FIG. 11 is a cross sectional view illustrating the thermal inkjet printhead after forming the LDD regions 1126. A blanket implant of a suitable dopant, such as phosphorous, is performed to form the LDD regions 1126.

Figure 12:
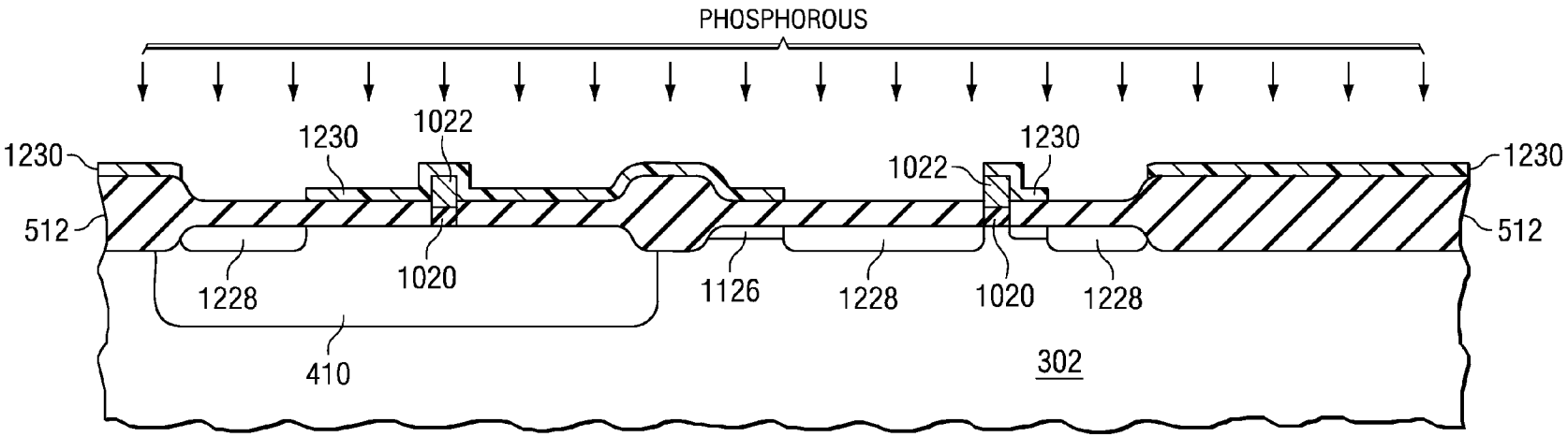
FIG. 12 is a cross sectional view illustrating the thermal inkjet printhead during formation of the n-type source drain regions array in accordance with an aspect of the present invention.

N-type source drain regions 1228 are formed at block 218. FIG. 12 is a cross sectional view illustrating the thermal inkjet printhead during formation of the n-type source drain regions 1228. A suitable n-type dopant, such as phosphorous, is implanted at a suitable energy (e.g., 100 keV) and a suitable dose (e.g., 5.25 E15). A layer of resist 1230 is employed to selectively form the n-type regions. Additionally, it is appreciated that the n-type regions 1228 are relatively highly doped, as compared to the n-well region 410 and the substrate 302.

Figure 13:
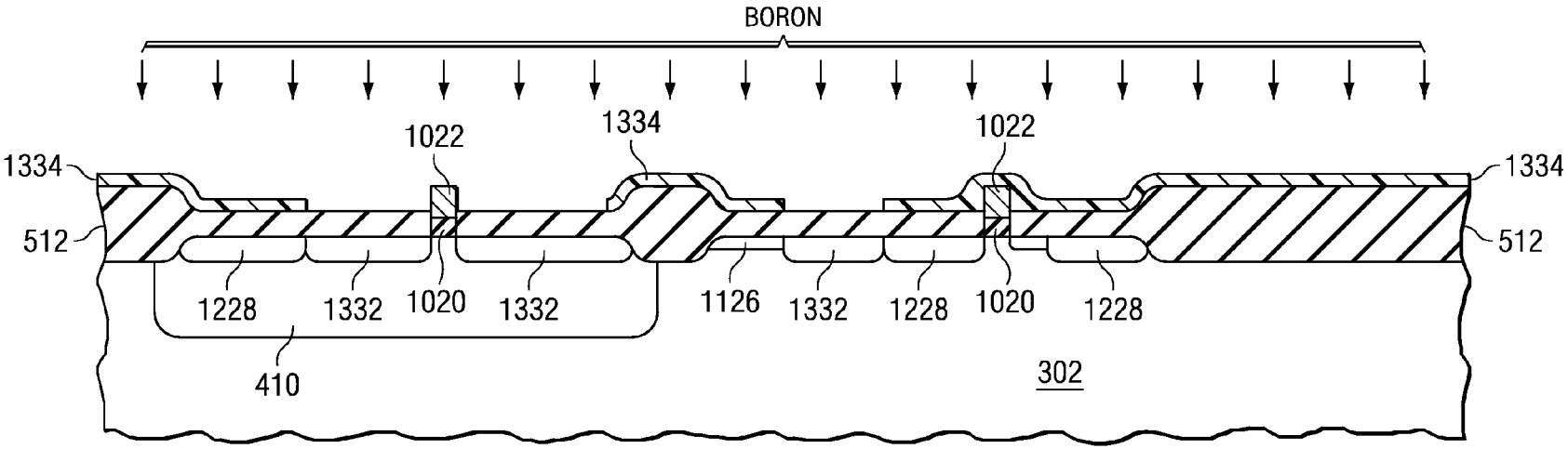
FIG. 13 is a cross sectional view illustrating the thermal inkjet printhead during formation of the p-type source drain regions array in accordance with an aspect of the present invention.
Figure 14:
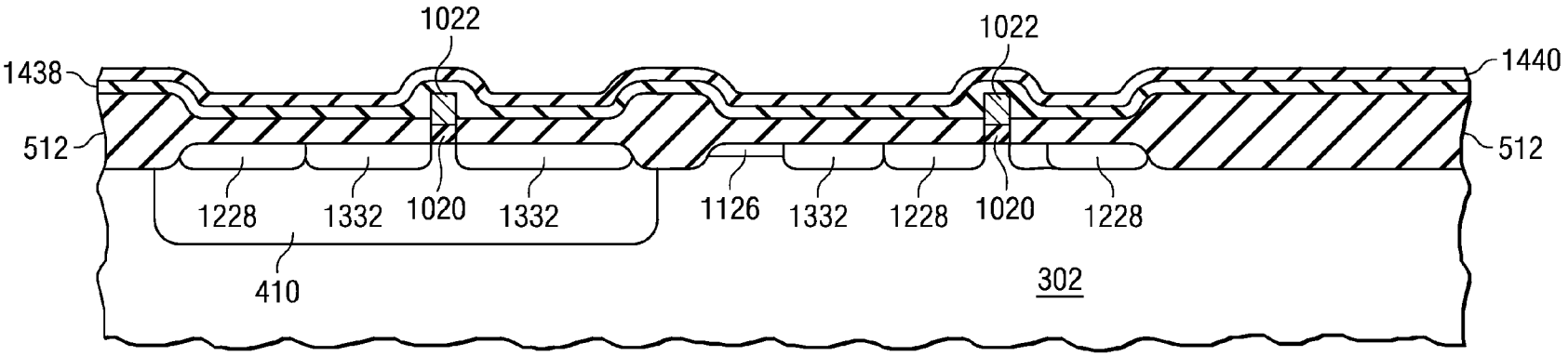
FIG. 14 is a cross sectional view illustrating the thermal inkjet printhead after formation of the BPSG layer array in accordance with an aspect of the present invention.

P-type source drain regions 1332 are formed at block 220. FIG. 13 is a cross sectional view illustrating the thermal inkjet printhead during formation of the p-type source drain regions 1332. A suitable p-type dopant, such as boron, is implanted at a suitable energy (e.g., 100 to 120 keV) and a suitable dose (e.g., 1E12 to 1E14). A layer of resist 1334 is employed to selectively form the p-type regions 1332 and is removed after formation of the regions 1332. Additionally, it is appreciated that the p-type regions 1332 are relatively highly doped Continuing with the method 200, a boro-phospho-silicate (BPSG) layer 1440 is formed over the device at block 222. FIG. 14 is a cross sectional view illustrating the thermal inkjet printhead after formation of the BPSG layer 1440. Initially, a uniform-silicon-glass (USG) layer 1438 is formed over the device having a suitable thickness, for example 2,000 Angstroms. Then, the BPSG layer 1440 is formed on the USG layer 1438 and has a suitable thickness, for example, 7,000 Angstroms. Subsequently, an annealing operation is performed that repairs damage incurred during the formation of the p-type regions 1332 and the n-type regions 1228.

Figure 15:
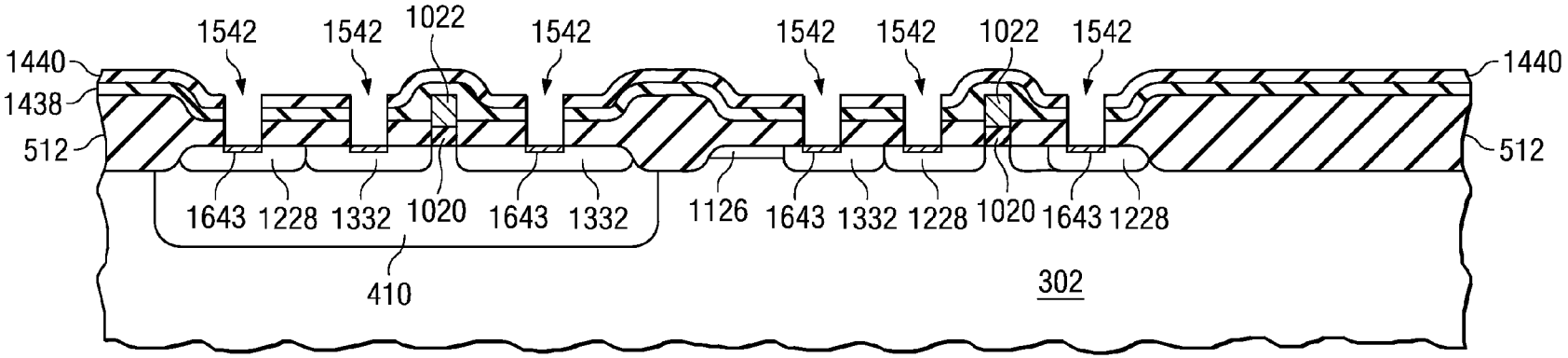
FIG. 15 is a cross sectional view illustrating the thermal inkjet printhead after formation of the contact vias array in accordance with an aspect of the present invention.

Active region contacts vias 1542 are formed through the BPSG layer 1440 and the USG layer 1438 to the p-type regions 1332 and the n-type regions 1228 at block 224. FIG. 15 is a cross sectional view illustrating the thermal inkjet printhead after formation of the contact vias 1542. A layer of photoresist (not shown) is employed to selectively expose portions to be etched. Subsequently, an etch is performed that substantially removes material from the BPSG layer 1440, the USG layer 1438, and the oxide 512 thereby forming the active region contact vias 1542.

Figure 16:
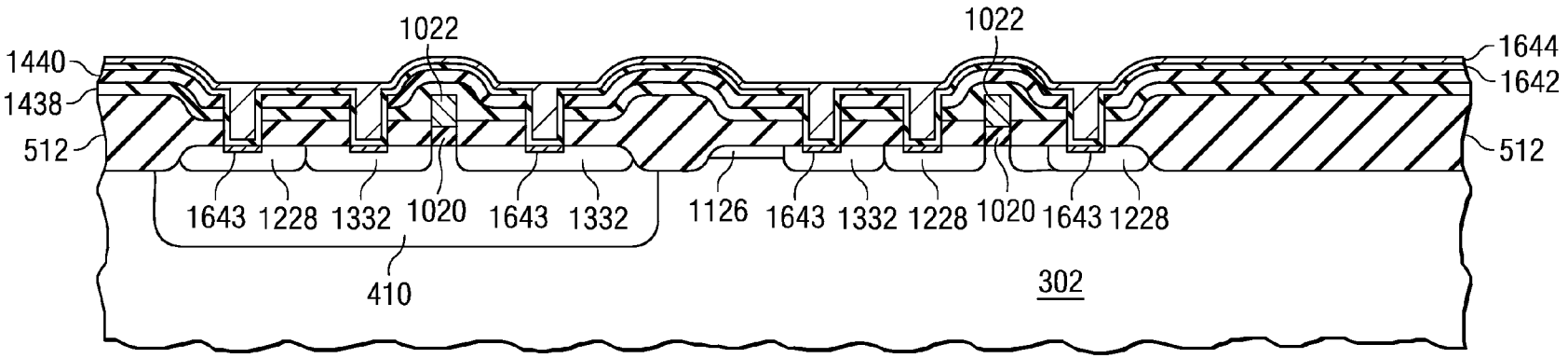
FIG. 16 is a cross sectional view illustrating the thermal inkjet printhead subsequent to depositing the resistive layer and the first metal layer array in accordance with an aspect of the present invention.

At block 226, a resistive layer 1642 and a first metal layer 1644 are deposited over the device. FIG. 16 is a cross sectional view illustrating the thermal inkjet printhead subsequent to depositing the resistive layer 1642 and the first metal layer 1644. The resistive layer 1642 is formed by sputtering a suitable material, such as Ta or TaAl to a suitable thickness (e.g., about 300 Angstroms to about 1,000 Angstroms), that generates heat in response to current passing through it. Then, the first metal layer 1644 is formed by sputtering a suitable metal material, such as AlCu, over the device to a thickness of about 5,200 Angstroms. As can be seen in FIG. 16, the first metal layer is formed within the contact vias 1542. Additionally, salicide regions 1643 are typically formed the bottom of the contact vias 1542 by depositing a refractory metal that reacts with underlying semiconductor material.

Figure 17:
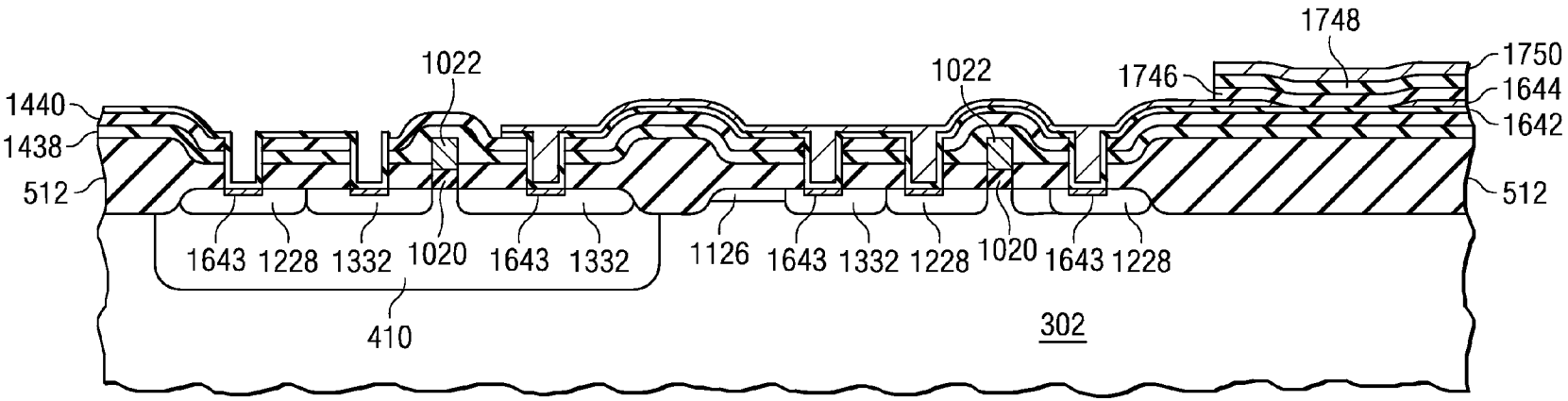
FIG. 17 is a cross sectional view illustrating the thermal inkjet printhead after depositing the heating element layers array in accordance with an aspect of the present invention.

A heating element s formed on the device at block 228 by selectively etching a portion of the first metal layer 1644 and depositing upper heating element layers. FIG. 17 is a cross sectional view illustrating the thermal inkjet printhead after depositing the heating element layers. Initially, a selected portion of the first metal layer 1644 is removed and a silicon-nitride layer 1746 is deposited over the device. The silicon-nitride layer 1746 acts as a thermal barrier. An example of a suitable thickness for the silicon-nitride layer 1746 is about 2,600 Angstroms to about 4,600 Angstroms. Then, a silicon-carbon layer 1748 is deposited over the device and on the silicon-nitride layer 1746 with a thickness, for example, of about 1,200 Angstroms to about 2,600 Angstroms. A tantalum layer 1750 is then deposited over the device and has a suitable thickness, for example of about 6,000 Angstroms. The tantalum layer 1750 serves to protect the thermal inkjet printhead from cavitation during ink bubble generation. The silicon-nitride layer 1746, the silicon-carbon layer 1748, and the tungsten layer 1750, referred to as the upper heating element layers, are then selectively etched. Although the heating element layers are described with respect to particular materials, it is appreciated that other suitable materials for forming a heating element can be employed in accordance with the present invention.

Figure 18:
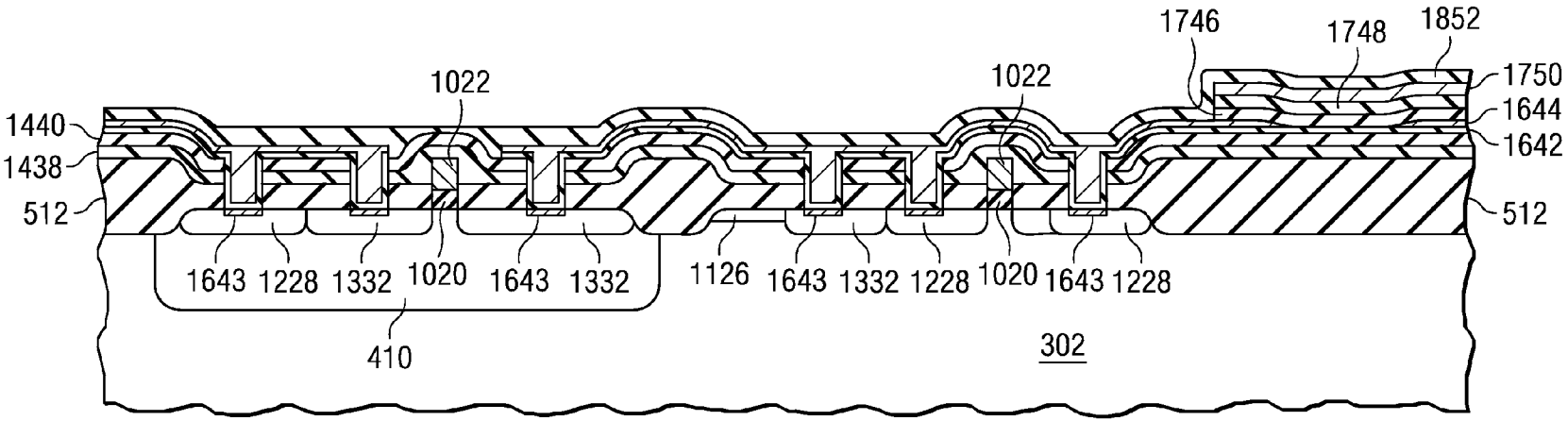
FIG. 18 is a cross sectional view illustrating the thermal inkjet printhead after depositing the IMD layer array in accordance with an aspect of the present invention.
Figure 19:
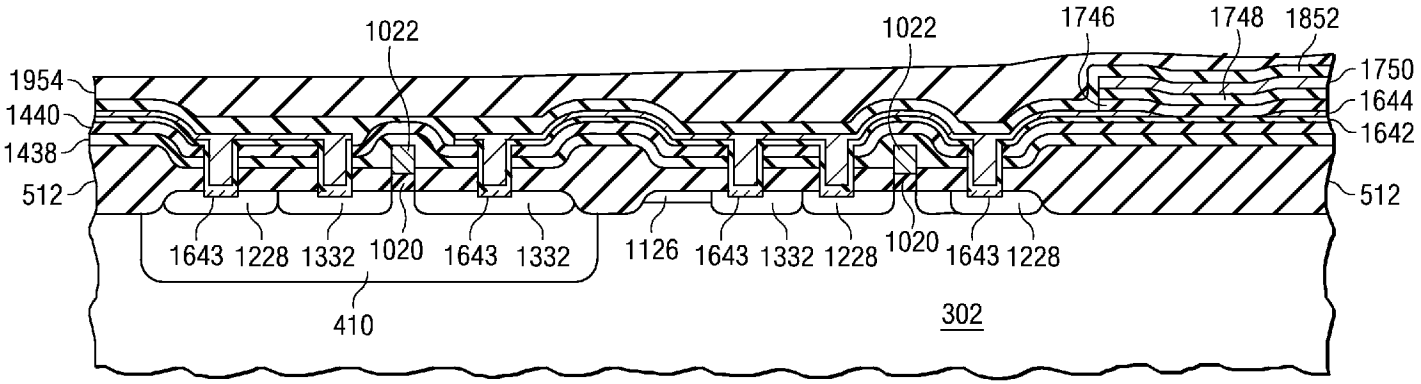
FIG. 19 is a cross sectional view illustrating the thermal inkjet printhead after depositing the silicon dioxide layer array in accordance with an aspect of the present invention.
Figure 20:
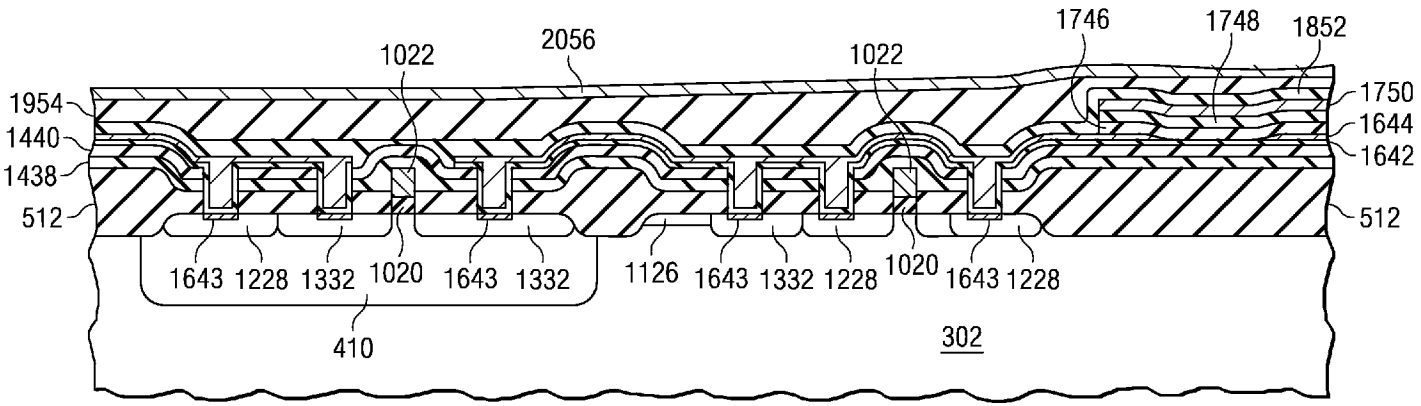
FIG. 20 is a cross sectional view illustrating the thermal inkjet printhead after formation of the second metal layer array in accordance with an aspect of the present invention.

An IMD layer 1852 is formed on the device at block 230 by depositing a suitable material over the device. FIG. 18 is a cross sectional view illustrating the thermal inkjet printhead after depositing the IMD layer 1852. Continuing at block 232, a silicon dioxide layer 1954 is formed over the device. FIG. 19 is a cross sectional view illustrating the thermal inkjet printhead after depositing the silicon dioxide layer 1954. Lastly, a second metal layer 2056 is deposited over the device at block 234. A suitable material such as AlCu is sputtered to a thickness of, for example, 11,000 Angstroms. FIG. 20 is a cross sectional view illustrating the thermal inkjet printhead after formation of the second metal layer 2056. Subsequent processes can then be performed, such as chamber formation, nozzle plate formation, depositing protective layers and packaging, in order to complete fabrication of the thermal inkjet printhead.

The method 200 as well as the associated FIGS. 3-20 are provided to illustrate one suitable method of fabricating a thermal inkjet printhead in accordance with the present invention. It is appreciated that variations in processes performed, order in which processes performed, and materials employed are contemplated in accordance with the present invention as long as a printhead is fabricated that includes a heater element and a memory array that can be employed for identification purposes.

Figure 21:
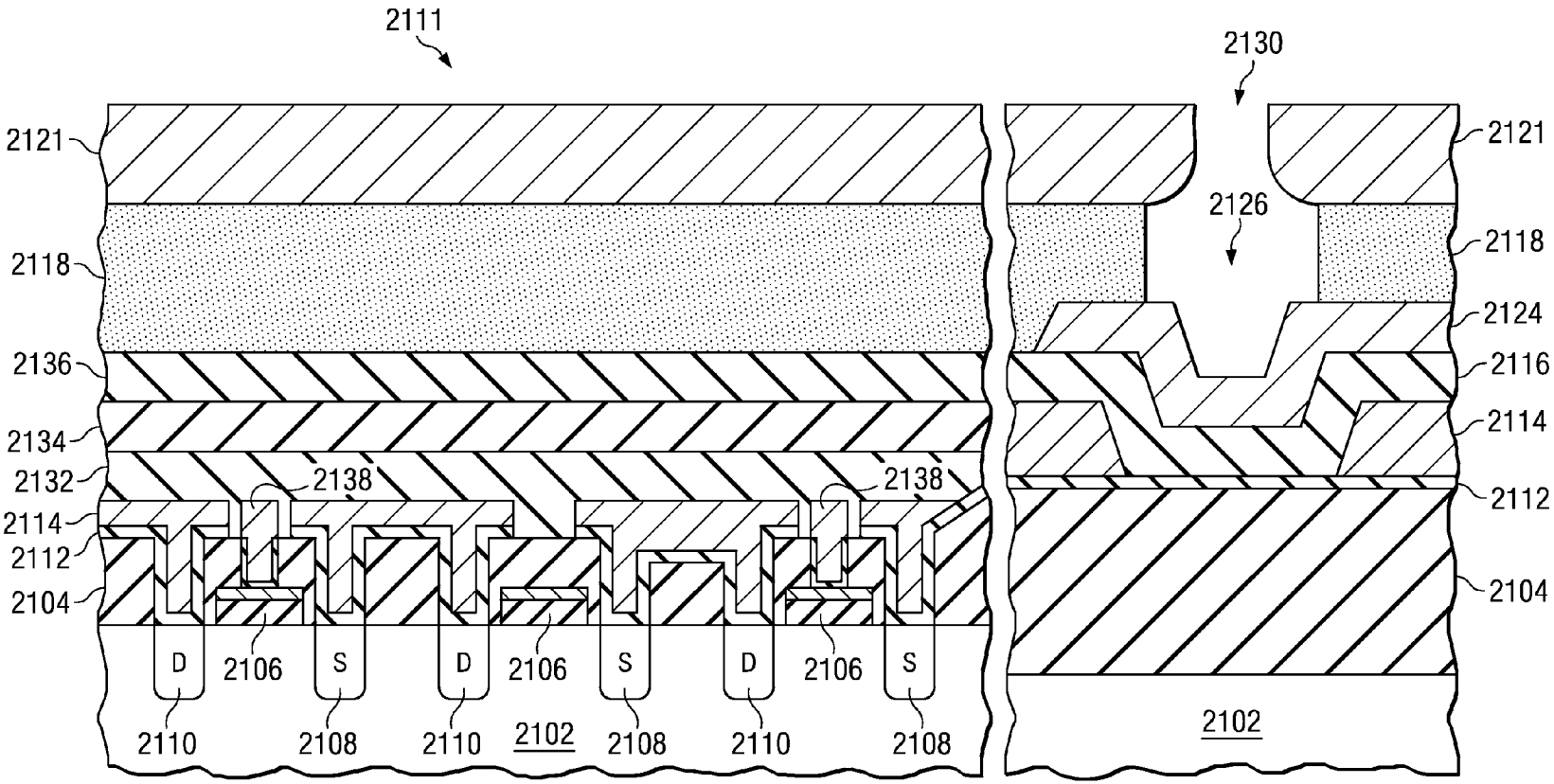
FIG. 21 is a cross sectional view illustrating a fabricated thermal inkjet printhead in accordance with an aspect of the present invention is provided.

Turning now to FIG. 21, another cross sectional view illustrating a fabricated thermal inkjet printhead in accordance with an aspect of the present invention is provided. The thermal inkjet printhead includes a heating element and a memory array for identification purposes. The memory array includes a number of CMOS memory cells that can maintain identification information about the thermal inkjet printhead.

A field oxide layer 2104 is formed on a silicon substrate 2102 by growing silicon dioxide and then selectively etching portions of the field oxide layer 2104 in a memory cell region 2111. Source regions 2108 and drain regions 2110 are formed in the silicon substrate 2102 adjacent to portions of the field oxide layer 2104. Polysilicon gates 2106 are formed over the source regions 2108 and the drain regions 2110 and are encased in an insulative material, such as oxide. The polysilicon gates 2106, the source region 2108, and the drain region 2110 define CMOS memory cells 2111.

A resistive layer 2112 is formed on the field oxide layer 2104, the source region 2108 and the drain region 2110. The resistive layer 2112 is comprised of a suitable resistive material such as tantalum-aluminum, which generates heat on current passing through it. A first metal layer 2114 (e.g., comprised of aluminum) is formed on the resistive layer 2112 and is selectively removed from a heating element region 2122. An interlevel insulative layer 2116, comprised of an insulative material such as SiC or SiN, is formed on the first metal layer 2114 and on a portion of the resistive layer 2112. The interlevel insulative layer 2116 acts as a thermal barrier that protects the CMOS memory cell 2111 from the heating element region 2122. A protective layer 2124, typically comprised of tantalum, is deposited via a sputtering process on the interlevel insulative layer 2116 and etched so that a portion remains in the heating element region 2122. The protective layer 2124 serves to mitigate or prevent harmful effects due to cavitation from generation of heat bubbles. For the CMOS memory cells 2111, a lower insulative layer 2132 comprised of an insulative material such as silicon dioxide (SILOX) is formed on the first metal layer 2114. An intermediate layer 2134 (SOG) is formed on the lower insulative layer 2132 and an upper insulative layer 2136 (SILOX) is formed on the intermediate layer 2134. The intermediate layer 2134 can be comprised of a conductive material.

An ink barrier layer 2118 is selectively formed on the insulative layer 2116, the protective layer 2124, and on the upper insulative layer 21346 thereby defining an ink firing chamber 2126 above the heating element 2122. A nozzle plate 2121 is formed on the ink barrier layer 2118 to allow ejection of ink bubbles from the ink chamber 2126 through a nozzle opening 2130. Although not shown, channels and ink reservoir(s) are present that transport ink from the ink reservoir(s) to the ink firing chamber 2126 as needed.

During operation, heat bubbles are generated by pulsing current through a heating element portion of the resistive layer 2112 by way of the first metal layer. The generated heat bubbles pass through the nozzle opening 2130 and, ultimately, attach to a print medium. The CMOS memory cell 2111 is programmed by connecting the source region 2108 to ground and applying a program voltage (e.g., 10 volts) to the drain region 2110. The CMOS memory cell 2111 is read by connecting the source region 2108 to ground and applying a read voltage (e.g., about 2 volts) to the drain region 2110 and measuring source drain current. If the source drain current is below a threshold value (e.g., on the order of sub-microns of current), the memory cell 2111 is deemed un-programmed. If the source current is above the threshold value, the memory cell 2111 is deemed programmed. As fabricated, the memory cell 2111 is initially in an un-programmed state.

Figure 22:
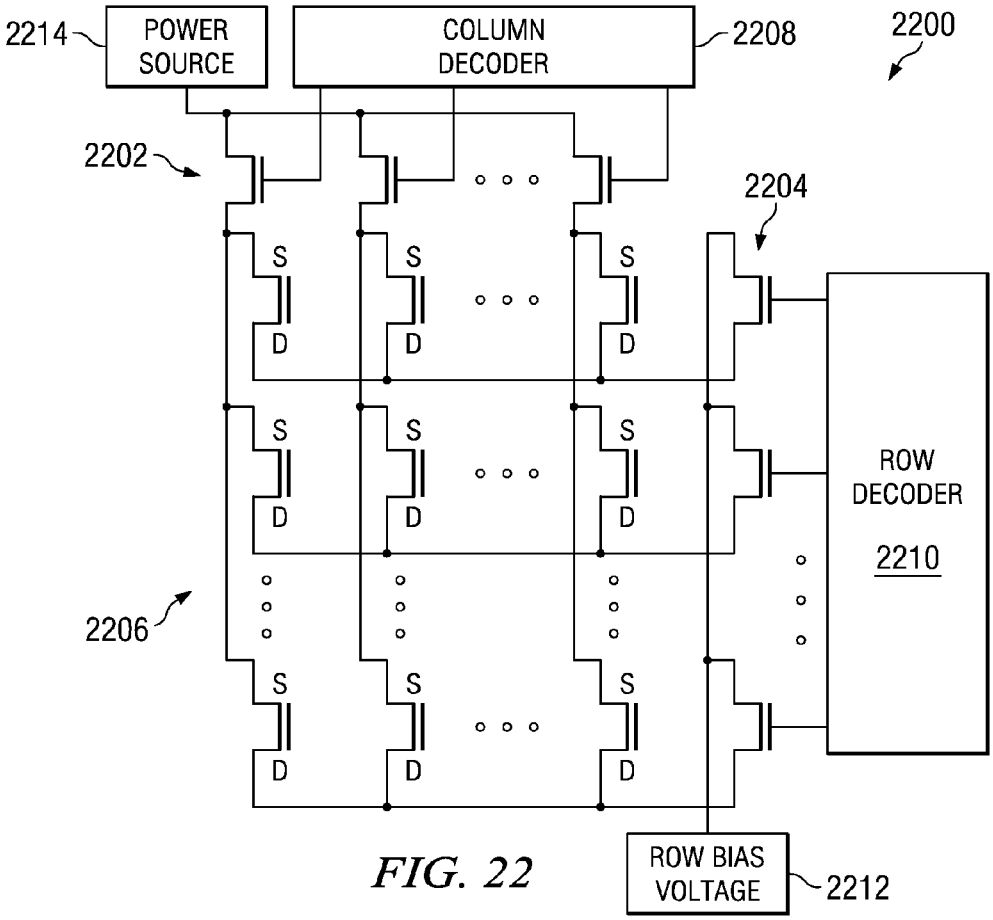
FIG. 22 is a schematic diagram illustrating a thermal inkjet printhead memory array 2200 in accordance with an aspect of the present invention.

FIG. 22 is a schematic diagram illustrating a thermal inkjet printhead memory array 2200 in accordance with an aspect of the present invention. The memory array 2200 illustrates addressing of individual and multiple memory cells. The array 2200 includes column transistors 2202, row transistors 2204, a number of memory cells 2206, a column decoder 2208, a row decoder 2210, a row bias voltage source 2212, and a column power source 2214.

The column transistors 2202 selectively connect sources of memory cells 2206 to the column power source 2214 and the row transistors 2204 selectively connect drains of the memory cells 2206 to the row bias voltage 2212. The column decoder 2208 controls the operation of the column transistors 2202 and the row decoder 2210 controls the operation of the row transistors 2204.

An individual memory cell is programmed by turning on an appropriate column transistor and an appropriate row transistor thereby connecting the column power source 2214 to the source of the memory cell and connecting the row bias voltage 2212 to the drain of the memory cell. As a result, a program voltage (e.g., 10 volts) is applied across the source and drain regions, which results in raising a threshold voltage for the programmed memory cell. An individual memory cell is read by again turning on an appropriate column transistor and an appropriate row transistor thereby connecting the column power source 2214 to the source of the memory cell and connecting the row bias voltage 2212 to the drain of the memory cell. Here, the column power source 2214 and the row bias voltage 2212 apply a read voltage (e.g., 2 volts) across the source and drain regions. Then, source-drain current is measured and compared to a threshold value. If the measured source-drain current is below the threshold value, the cell is deemed to have one logical value, otherwise the cell is deemed to have its complement logical value.

Figure 23:
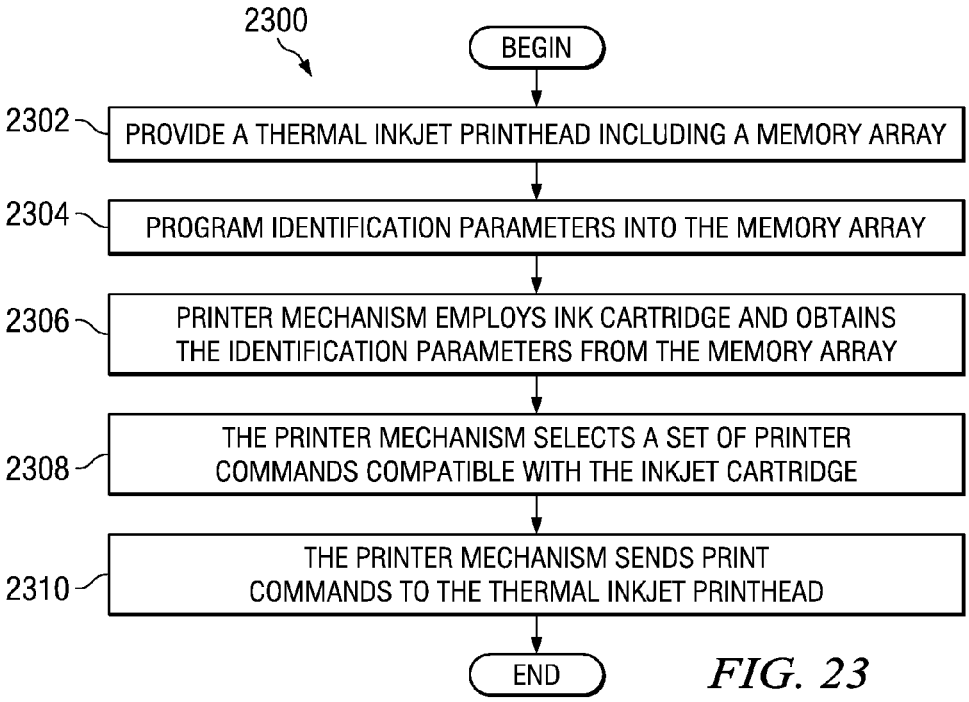
FIG. 23 is a flow diagram illustrating a method 2300 of accessing and providing identification parameters for a thermal inkjet printhead in accordance with an aspect of the present invention.

In view of the foregoing structural and functional features described supra, methodologies in accordance with various aspects of the present invention will be better appreciated with reference to the above figures. While, for purposes of simplicity of explanation, the methodology of FIG. 23 is depicted and described as executing serially, it is to be understood and appreciated that the present invention is not limited by the illustrated order, as some aspects could, in accordance with the present invention, occur in different orders and/or concurrently with other aspects from that depicted and described herein. Moreover, not all illustrated features may be required to implement a methodology in accordance with an aspect the present invention.

FIG. 23 is a flow diagram illustrating a method 2300 of accessing and providing identification parameters for a thermal inkjet printhead in accordance with an aspect of the present invention.

The method 2300 begins at block 2302, wherein a thermal inkjet printhead comprising a memory array is provided. The thermal inkjet printhead can be obtained by employing the fabrication method 200 of FIG. 2, described above, as well as variations thereof. The thermal inkjet printhead has at least a heating element, an ink reservoir that supplies ink to the heating element, one or more channels that flow ink from the ink reservoir to the heating element, a chamber employed in generation of ink bubbles, the memory array comprised of one or more memory cells, and a number of transistors that selectively drive the heating elements.

At block 2304, identification parameters are programmed into the memory array. The identification parameters include color(s) of ink (e.g., black, green, red, blue), a number of nozzles present on the thermal inkjet printhead, an addressing frequency, nozzle spacing, heating architecture, and the like. The identification parameters can include other information such as a unique serial identification number for the thermal inkjet printhead, manufacturer serial number, lot number, date of manufacture, compatible printers, ink capacity, ink remaining, re-ordering information for replacement ink cartridges, and the like.

The identification parameters can be programmed into the memory array by allocating a number of memory cells for each parameter to be included. Then, the parameters stored in the memory array by programming appropriate memory cells for each parameter to be stored. This programming can be performed prior to packaging of the thermal inkjet printhead in an ink cartridge, but can also be performed after packaging. The identification parameters can be initially supplied by a device external to the thermal inkjet printhead, such as a computer system.

A printer mechanism employs the ink cartridge comprising the thermal inkjet printhead and obtains the identification parameters from the memory array at block 2306. The printer mechanism initiates obtaining the identification parameters by sending a request. In response, the thermal inkjet printhead identifies and collects the identification parameters and sends them to the printer mechanism. The thermal inkjet printhead has circuitry and connection points that can be configured to send the identification parameters in a serial or parallel data stream. Based on the identification parameters, the printer mechanism selects or generates a set of printer commands or directives that are suitable for the ink jet cartridge at block 2308.

At block 2310, the printer mechanism sends print commands to the thermal inkjet printhead causing the ink cartridge to print on a printable medium, such as paper. The print commands can direct one or more nozzles to generate ink bubbles from their associated ink supply. Since the one or more nozzles can have varied color ink supplies, the print commands can result in multiple colors being printed. Additionally, the print commands can result in varied thickness, weight, intensity, and the like to attain desired printing results.

Although the invention has been shown and described with respect to a certain aspect or various aspects, it is obvious that equivalent alterations and modifications will occur to others skilled in the art upon the reading and understanding of this specification and the annexed drawings. In particular regard to the various functions performed by the above described components (assemblies, devices, circuits, etc.), the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several aspects of the invention, such feature may be combined with one or more other features of the other aspects as may be desired and advantageous for any given or particular application. Furthermore, to the extent that the term "includes" is used in either the detailed description or the claims, such term is intended to be inclusive in a manner similar to the term "comprising."

What is claimed is:

1. A thermal inkjet printing system comprising:

a printing mechanism; and a printhead comprising:

a memory array that stores identification parameters, wherein the memory array comprises: column transistors coupled to sources associated with a first number of CMOS memory cells along a column direction and row transistors coupled to drains associated with a second number of CMOS memory cells along a row direction, wherein a column transistor and row transistor are configured to address solely an individual memory cell and apply a read voltage across a source and drain of the individual memory cell to facilitate measurement of source-drain current;

one or more heating elements that controllably generate ink bubbles; and a control circuit that responds to print directives from the printing mechanism, drives the one or more heating elements, and causes the identification parameters to be provided to the printing mechanism in response to an identification directive.

2. The system of claim 1, wherein the print directives employed by the printing mechanism are associated with the identification parameters.

3. The system of claim 1, wherein the identification parameters include color(s) of ink, a number of nozzles on the printhead, an addressing frequency, nozzle spacing, and heating architecture.

4. The system of claim 1, wherein the memory array, the one or more heating elements, and the control circuit are formed on a single integrated circuit.

5. The system of claim 1, further comprising at least one additional printhead.

6. The system of claim 1, wherein the identification parameters include a unique serial identification number for the printhead, manufacturer serial number, lot number, date of manufacture, compatible printers, number of nozzles, color (s) of ink, ink capacity, ink remaining, and re-ordering information for replacement ink cartridges.

7. The system of claim 6, wherein the color(s) of ink is black and the number of nozzles is three.

8. The system of claim 6, wherein the color(s) of ink are red, blue, and green and the number of nozzles is 6.

9. A thermal inkjet printhead comprising:

a memory array that stores identification parameters concerning the thermal inkjet printhead, wherein the memory array comprises: column transistors coupled to sources associated with a number of CMOS memory cells and row transistors coupled to drains associated with the number of CMOS memory cells, wherein a column transistor and row transistor are configured to address solely an individual memory cell and apply a read voltage across a source and drain of the individual memory cell to facilitate a measure of source-drain current;

one or more heating elements and associated ink chambers that controllably heat ink within the ink chambers and generate ink bubbles; and a control circuit coupled to the memory array and the one or more heating elements that programs and stores the identification parameters in the memory array and that controls generation of ink bubbles by selectively driving the one or more heating elements.

10. The thermal inkjet printhead of claim 9, wherein the memory array, the one or more heating elements, and the control circuit are formed on a single integrated circuit.

11. The thermal inkjet printhead of claim 9, wherein the memory array has a storage capacity of at least 1024 kilo-bits.

12. The thermal inkjet printhead of claim 9, wherein the one or more heating elements comprise a thin film resistor.

13. The thermal inkjet printhead of claim 9, further comprising an ink reservoir that supplied ink to the one or more heating elements and one or more channels that flow ink from the ink reservoir to the one or more heating elements.

* * * * *